US007661155B2

(12) United States Patent
Yang

(10) Patent No.: US 7,661,155 B2
(45) Date of Patent: Feb. 16, 2010

(54) LATERAL DRIVING FAUCET WATER OUTLET SEAT

(76) Inventor: Tsai-Chen Yang, 235 Chung-Ho, Box 8-24, Taipei (TW)

( * ) Notice: Subject to any disclaimer, the term of this patent is extended or adjusted under 35 U.S.C. 154(b) by 589 days.

(21) Appl. No.: 11/586,702

(22) Filed: Oct. 26, 2006

(65) Prior Publication Data

US 2008/0098515 A1 May 1, 2008

(51) Int. Cl.
*E03C 1/04* (2006.01)

(52) U.S. Cl. ..... 4/678; 4/675; 137/801

(58) Field of Classification Search ..... 4/675–678; 137/359, 801; 239/600
See application file for complete search history.

(56) References Cited

U.S. PATENT DOCUMENTS 5,232,008 A * 8/1993 Jeffress et al. ..... 137/15.01
5,946,746 A * 9/1999 Bloom ..... 4/675
6,220,279 B1 * 4/2001 Segien ..... 137/359
6,360,770 B1 * 3/2002 Buchner et al. ..... 137/315.12
6,405,749 B1 * 6/2002 Bloom et al. ..... 137/359
6,491,058 B1 * 12/2002 Wang ..... 137/359
6,631,730 B1 * 10/2003 Bloom et al. ..... 137/359
6,668,393 B1 * 12/2003 Mascari et al. ..... 4/678
6,725,472 B2 * 4/2004 Gray et al. ..... 4/684
7,055,545 B2 * 6/2006 Mascari et al. ..... 137/359
7,472,434 B1 * 1/2009 Moldthan et al. ..... 4/678

* cited by examiner

*Primary Examiner*—Sam Chuan C Yao
*Assistant Examiner*—Janie Christiansen

(57) ABSTRACT

A lateral driving faucet water outlet seat comprises a water input outer tube placed; a surface of the water input outer tube being formed with a confining portion; a lower clamping stop having a polygonal outer sides; a limiting unit having a hexagonal engaging portion extended from a lower side of the limiting unit for engaging with the outer side of the lower clamping stop; a top of the engaging portion being enlarged with a resisting ring; an inner edge being formed with a limiting portion at a position corresponding to the confining portion of the water input outer tube for confining the rotation of the water input outer tube; an upper clamping stop having a polygonal outer side; and a water outlet base placed upon an upper side of the combining object; the water outlet base having a water outlet hole for receiving the combining section.

10 Claims, 6 Drawing Sheets

LATERAL DRIVING FAUCET WATER OUTLET SEAT

FIELD OF THE INVENTION

The present invention relates to a lateral driving faucet water outlet seat, wherein the water outlet seat can be installed rapidly.

BACKGROUND OF THE INVENTION

A faucet for cool and hot water is widely used. The installation of the faucet is that a panel is installed on a basin. The handle seats for cold and hot waters are installed at two sides of the panel. A water outlet seat is installed between the two handles. The water outlet seat is communicated to the water inlet tubes of the cool and hot water so as to adjust the volume of the cool and hot water.

Referring to FIGS. 5 and 6, the water outlet seat is integral formed with the water tubes. In installation, the water outlet seat is placed at an upper side of the basin and a drain-proof washer, a locking sheet are used to lock a T tube to a lower side of the basin.

The prior art faucets are installed to a basin with a small operating space. Thus it is difficult to assemble the water input outer tube by operating a spanner at the lower side. More time and labors are needed. Furthermore, it is frequently that faucets with special specifications can not be used. Furthermore, in the prior art, the water outlet seat and water tubes are integrally formed. Before completing the installation work, the faucet must be installed to a combining object, and thus it is possible that the worker is hurt or the faucet is destroyed by collision.

SUMMARY OF THE INVENTION

Accordingly, the primary object of the present invention is to provide a lateral driving faucet water outlet seat, wherein the water outlet seat can be installed rapidly.

To achieve above objects, the present invention provides a lateral driving faucet water outlet seat which comprises a water input outer tube placed; a surface of the water input outer tube being formed with a confining portion; a lower clamping stop having a polygonal outer sides; a limiting unit having a hexagonal engaging portion extended from a lower side of the limiting unit for engaging with the outer side of the lower clamping stop; a top of the engaging portion being enlarged with a resisting ring; an inner edge being formed with a limiting portion at a position corresponding to the confining portion of the water input outer tube for confining the rotation of the water input outer tube; an upper clamping stop having a polygonal outer side; and a water outlet base placed upon an upper side of the combining object; the water outlet base having a water outlet hole for receiving the combining section; a combining section resisting against a wall of the water outlet hole so that water only flows from the water input outer tube into the water outlet hole, a pull rod penetrating through the water outlet base corresponding to the recess.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
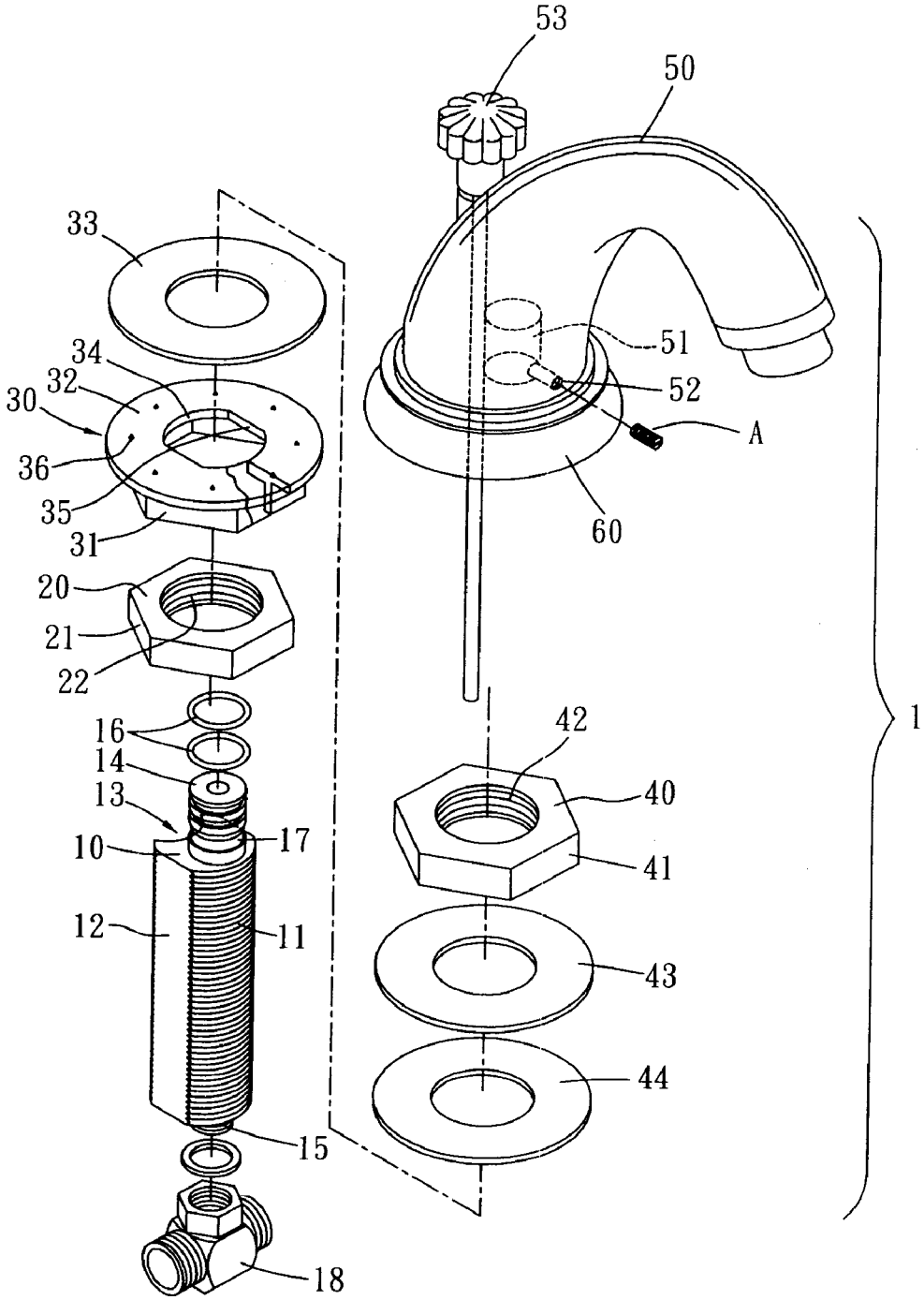
FIG. 1 is an explosive schematic view of the lateral driving faucet water outlet seat of the present invention.
Figure 2:
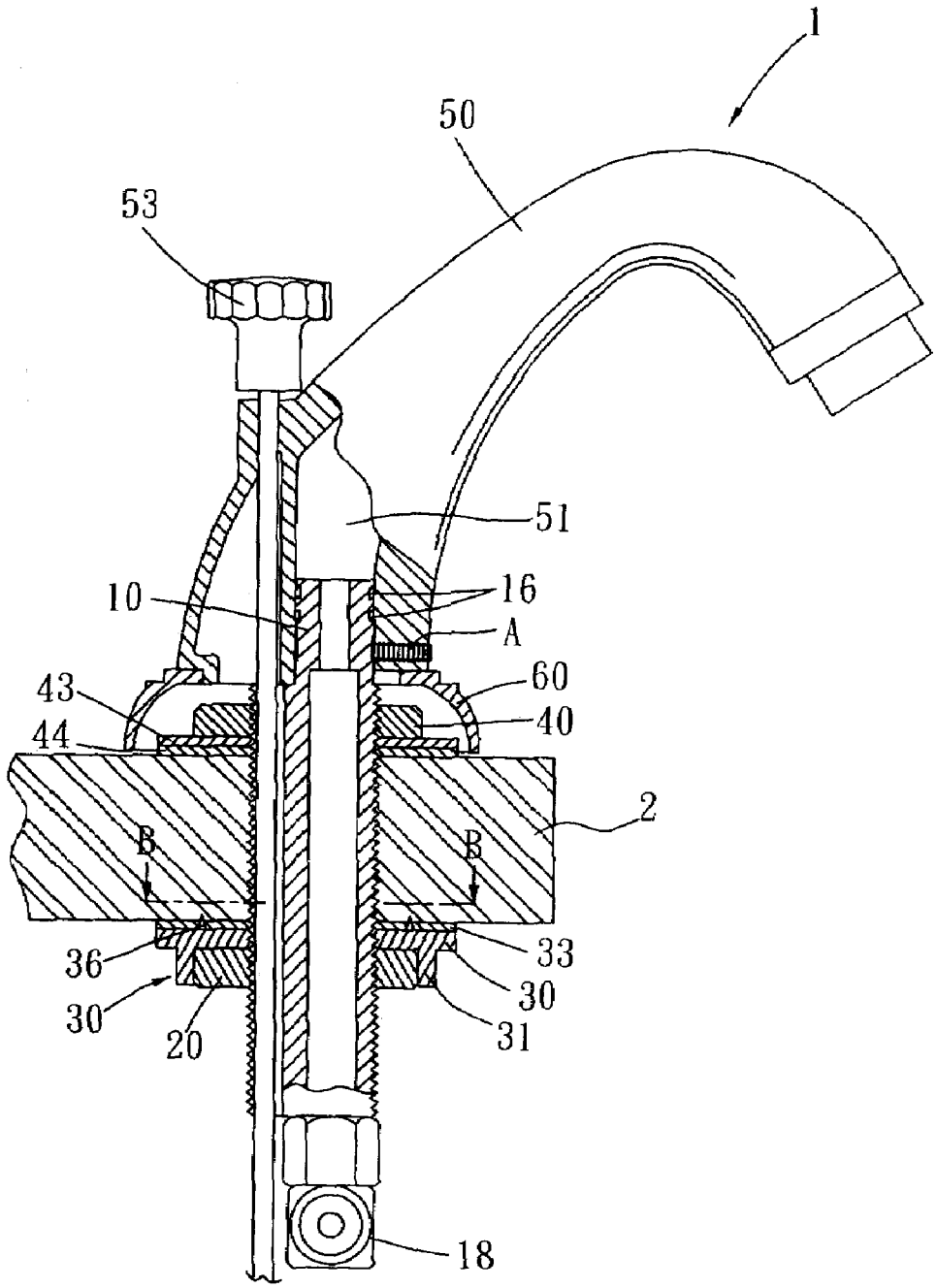
FIG. 2 is a schematic cross sectional view of the lateral driving faucet water outlet seat of the present invention.
Figure 3:
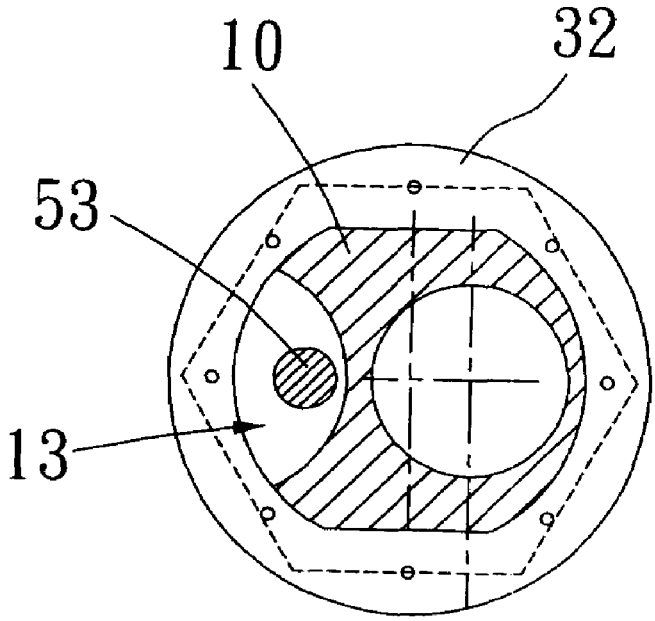
FIG. 3 is schematic view along line B-B of the present invention.
Figure 4:
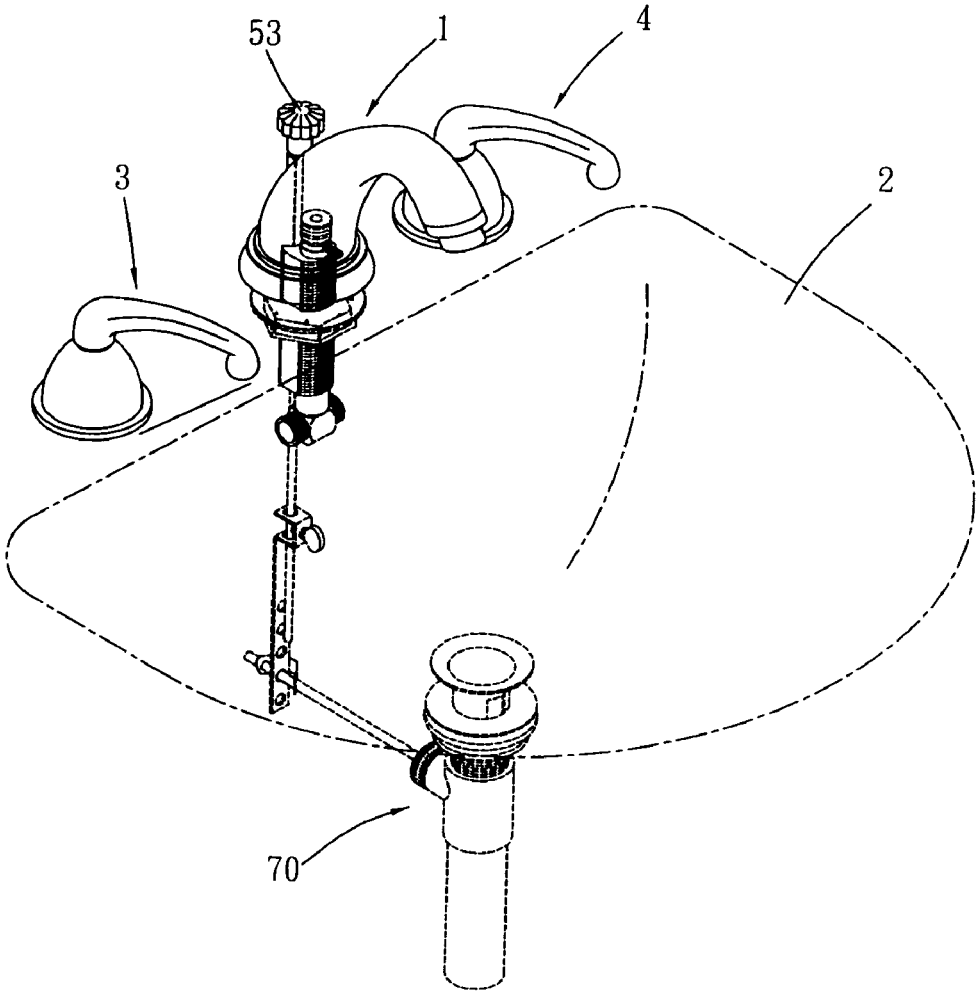
FIG. 4 shows that the present invention is combined with a basin according to the present invention.
Figure 5:
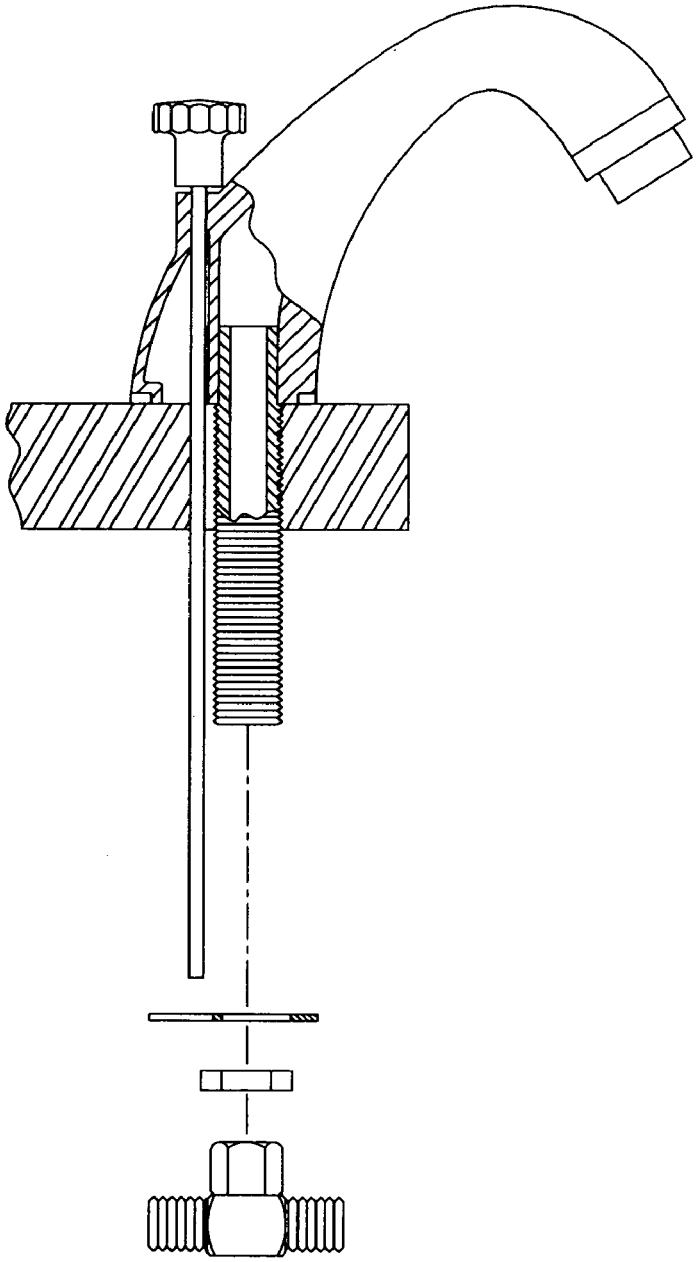
FIG. 5 (PRIOR ART)
FIG. 5 is a schematic view showing the assembly of the prior art faucet.
Figure 6:
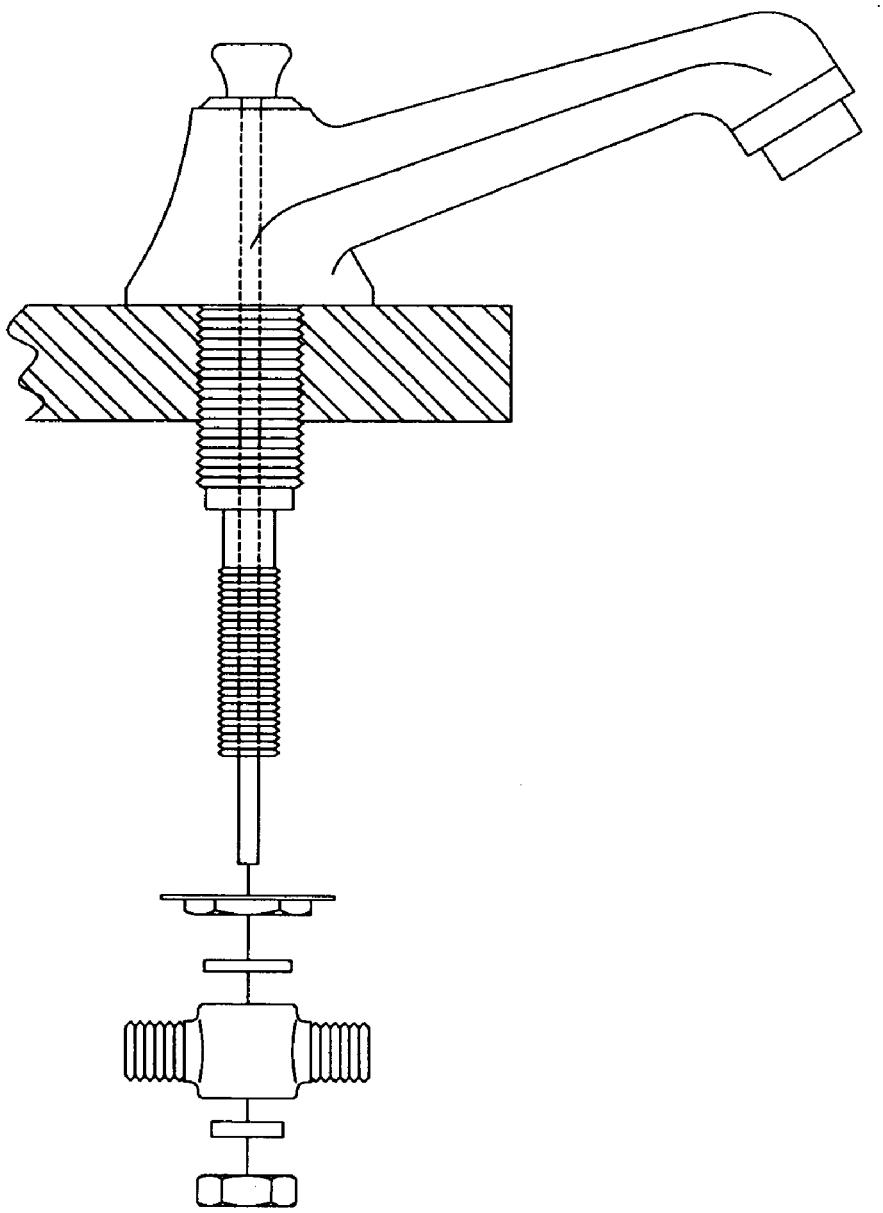
FIG. 6 (PRIOR ART)
FIG. 6 is an assembled view about another prior art faucet.

Referring to FIGS. 1 to 4, a lateral driving faucet water outlet seat 1 of the present invention is illustrated. The present invention has the following elements.

A water input outer tube 10 is placed into a lower side of a basin (or other object). A surface of the water input outer tube 10 is formed with an outer thread 11. Two opposite sides of a surface of the water input outer tube 10 are formed as planes which are used as a confining portion 12. Another side of the surface of the water input outer tube 10 is formed with a cambered recess 13. An upper side of the water input outer tube 10 is extended with a combining section 14 and a lower side thereof is formed with a threaded connecting section 15. Two drain-proof rings 16 are spaced apart and encloses the combining section 14. The combining section 14 is formed with a positioning groove 17 below the two drain-proof rings 16. The threaded connecting section 15 is screwed with a T tube 18. Two communicated openings of the T tube 18 are communicated to a cool water handle seat 3 and a hot water handle seat 4, respectively. Thus, cool water and hot water can pass through the T tube 18 and water input outer tube 10 to flow out for using.

A lower clamping stop 20 has a hexagonal outer sides with corners 211 and an interior of the lower clamping stop 20 is formed with inner thread 22 for screwing with the outer thread 11 of the water input outer tube 10.

A T shape limiting unit 30 has a hexagonal engaging portion 31 extended from a lower side of the limiting unit 30 for engaging with the outer side of the lower clamping stop 20. A top of the engaging portion 31 is enlarged with a resisting ring 32 which is used to adhere with a lower surface of a combining object 2. A drain-proof washer 33 is installed between the engaging portion 31 and the combining object 2. An upper side of the resisting ring 32 is extended with an inner edge 34 at the connection of the resisting ring 32 and the engaging portion 31 for resisting against the lower clamping stop 20 which is engaged into the engaging portion 31. The inner edge 34 is formed with a cut surface as a limiting portion 35 at a position corresponding to the confining portion 12 of the water input outer tube 10 for confining the rotation of the water input outer tube 10.

An upper clamping stop 40 has an hexagonal outer side 41 and an interior thereof is formed with an inner thread 42 for screwing with the outer thread 11 of the water input outer tube 10. The upper clamping stop 40 resists against an upper side of the combining object 2 by using a washer 43 and a drain proof washer 4.

A water outlet base 50 has a decorating cover 60 at a lower side thereof. The water outlet base 50 is placed upon an upper side of the combining object 2. The water outlet base 50 has a water outlet hole 51 for receiving the combining section 14. A combining section 14 resists against a wall of the water outlet hole 51 through the drain-proof ring 16 so that water only flows from the water input outer tube 10 into the water outlet hole 51. The decorating cover 60 at the lower side of the water outlet base 50 serves for covering the upper clamping stop 40 and the drain-proof washer 44 so as to present a beautiful outlook. A lateral side of the water outlet base 50 has a via hole 52 which is communicated with the water outlet hole 51 and exterior. A positioning unit A is received in the via hole 52 for resisting against the positioning groove 17 of the combining section 14 so as to position the water outlet base 50 and the water input outer tube 10. Besides, a pull rod 53 penetrates through the water outlet base 50 corresponding to the recess 13. The pull rod 53 is interacted with a water stop plug 70 at a water drain hole of the combining object 2. When the pull rod 53 is lifted, the plug 70 will seal the water drain hole and when the pull rod 53 descends, the plug 70 will separate from the water drain hole to drain waste water.

Assembly and operation of the present invention will be described hereinafter.

The water input outer tube 10 is installed from a lower side of the combining object 2. The position of the lower clamping stop 20 is adjusted according to a desired height. Then by the confinement of the confining portion 12 of the outer thread 11 of the water input outer tube 10 and the limiting portion 35 of the limiting unit 30, the water input outer tube 10 is steadily installed to the combining object 2. Meanwhile, by the engagement of the confining portion 12 and the limiting portion 35, the water outlet base 50 and the upper clamping stop 40 will not rotate idly when the upper clamping stop 40 presses downwards toward the combining object. Thus the user is unnecessary to clamp a lock sheet by using a hand tool as that in the prior art. In the present invention, the upper clamping stop 40 can enforce toward the upper end of the combining object 2 for positioning and then the water outlet base 50 passes through the combining section 14 of the water input outer tube 10. Finally, the positioning element A of the via hole 52 is positioned with the combining section 14 so as to achieve the object of rapid installation.

In the lateral driving faucet water outlet seat of the present invention, by the design of the confining portion 12 of the water input outer tube 10 to engage with the limiting portion 35 of the limiting unit 30 for confining the rotation of the components, when the upper clamping stop 40 rotates, the water outlet base 50 will not be driven to rotate. If the combining object is made of wooden or plastic material, a plurality of projections 36 can be installed on an upper surface of the resisting ring 32 of the limiting unit 30 for confining the rotation of the water input outer tube 10 and the combining object.

Further, in the present invention, the positioning element penetrates through the water outlet base 50 between the water outlet base 50 and water input, outer tube 10, the structure of the water outlet base 50 is simple and the installation can be positioned rapidly and conveniently.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A lateral driving faucet water outlet seat comprising:

a water input outer tube; a surface of the water input outer tube being formed with an outer thread; a surface of the water input outer tube being formed with a confining portion; another side of the surface of the water input outer tube being formed with a cambered recess; an upper side of the water input outer tube being extended with a combining section and a lower side thereof being formed with a threaded connecting section;

a lowering clamping stop having a polygonal outer sides and an interior of the lower clamping stop being formed with an inner thread for screwing with the outer thread of the water input outer tube;

a limiting unit having a hexagonal engaging portion extended from a lower side of the limiting unit for engaging with the outer side of the lower clamping stop; a top of the engaging portion being enlarged with a resisting ring; an upper side of the resisting ring being extended with an inner edge at the connection of the resisting ring and the engaging portion for resisting against the lower clamping stop which is engaged into the engaging portion; the inner edge being formed with a limiting portion at a position corresponding to the confining portion of the water input outer tube for confining the rotation of the water input outer tube;

an upper clamping stop having a polygonal outer side and an interior therefor being formed with an inner thread for screwing with the outer thread of the water input outer tube; the upper clamping stop resisting against an upper side of a combining object; and a water outlet base placed upon an upper side of the combining object; the water outlet base having a water outlet hole for receiving the combining section; a combining section resisting against a wall of the water outlet hole so that water only flows from the water input outer tube into the water outlet hole, and a pull rod penetrating through the water outlet base corresponding to the recess.

2. The lateral driving faucet water outlet seat as claimed in claim 1, wherein between a lower surface of the combining object and an upper side of the resisting ring comprising a drain-proof washer and between a lower side of the upper clamping stop and an upper surface of the combining object comprising a drain-proof washer.

3. The lateral driving faucet water outlet seat as claimed in claim 1, wherein two opposite sides of a surface of the water input outer tube are formed as planes which are used as a confining portion; and the inner edge being formed with a cut surface as a limiting portion.

4. The lateral driving faucet water outlet seat as claimed in claim 1, wherein a plurality of projections are formed on an upper surface of the resisting ring of the limiting unit for confining the rotation of the water input outer tube and the combining object.

5. The lateral driving faucet water outlet seat as claimed in claim 2, wherein a plurality of projections are formed on an upper surface of the resisting ring of the limiting unit for confining the rotation of the water input outer tube and the combining object.

6. The lateral driving faucet water outlet seat as claimed in claim 1, wherein the water outlet base is installed with a cover.

7. The lateral driving faucet water outlet seat as claimed in claim 1, wherein the threaded connecting section is screwed with a T tube; two communicated openings of the T tube are communicated to a cool water handle seat and a hot water handle seat, respectively; and thus, cool water and hot water can pass through the T tube and water input outer tube to flow out for using.

8. The lateral driving faucet water outlet seat as claimed in claim 1, wherein a lateral side of the water outlet base has a via hole which communicates the water outlet hole and exterior environment; a positioning unit is received in the via hole for resisting against the positioning groove of the combining section so as to position the water outlet base and the water input outer tube.

9. The lateral driving faucet water outlet seat as claimed in claim 1, wherein at least one drain-proof ring encloses the combining section; and the combining section is formed with a positioning groove below the two drain-proof rings for confining a positioning element.

10. The lateral driving faucet water outlet seat as claimed in claim 1, wherein the pull rod is interacted with a water stop plug at a water drain hole of the combining object.

* * * * *